United States Patent [19]

Baziuk

[11] Patent Number: 4,699,163

[45] Date of Patent: Oct. 13, 1987

[54] HEAD FOR CLEANING THE INTERIOR OF A PIPE

[76] Inventor: Slawko M. Baziuk, 3404 Parkdale Street, Winnipeg, Manitoba, Canada

[21] Appl. No.: 809,045

[22] Filed: Dec. 16, 1985

[51] Int. Cl.[4] ..... B08B 9/04

[52] U.S. Cl. ..... 134/167 C; 239/DIG. 13; 239/558; 239/560; 239/747

[58] Field of Search ..... 134/166 C, 167 C, 168 C; 4/255, 256, 257; 239/DIG. 13, 558, 559, 560, 561, 743, 744, 747

[56] References Cited

U.S. PATENT DOCUMENTS

| | | | |
|---|---|---|---|
| 1,448,876 | 3/1923 | Sladden | 134/167 C |
| 1,547,669 | 7/1925 | Powell | 239/120 |
| 1,803,425 | 5/1931 | Cunningham | 239/DIG. 13 |
| 2,515,600 | 7/1950 | Hayes | 239/559 X |
| 3,034,522 | 5/1962 | Lithun | 134/167 C |
| 3,449,783 | 6/1969 | Kirschke | 15/104.12 |
| 3,635,230 | 1/1972 | Kirschke | 134/168 C |

FOREIGN PATENT DOCUMENTS

| | | | |
|---|---|---|---|
| 2746781 | 5/1978 | Fed. Rep. of Germany | 134/166 C |

*Primary Examiner*—Philip R. Coe

*Attorney, Agent, or Firm*—Stanley G. Ade; Adrian D. Battison

[57] ABSTRACT

A head is disclosed for use in cleaning pipes using a technique in which the head projects water backwardly so as to be driven along the pipe pulling a water supply hose with the head following which the supply hose is pulled from the pipe to withdraw the head thus forcing collected debris from the pipe. The head comprises a cylindrical body having a nose and a rear wall in which the jets are positioned. The body is wrapped around by longitudinal skid bars spaced angularly of the cylindrical body and welded to the nose and welded to a coaxial pipe supplying water to the cylindrical body. The jets are inclined outwardly at a shallow angle of the order of 1° to 6°.

18 Claims, 4 Drawing Figures

HEAD FOR CLEANING THE INTERIOR OF A PIPE

BACKGROUND OF THE INVENTION

This invention relates to a head for cleaning the interior of a pipe.

Sanitary and storm sewers carrying generally liquid tend to become clogged over a long period of time by the collection of debris and other solid matter at the bottom of the pipe as the particles forming the debris fall out of suspension from the moving liquid. This debris unless it is periodically removed will eventually block the pipe and render it useless.

A technique is known for example from U.S. Pat. Nos. 3,380,461 (Maasberg), 3,678,948 (Hedges), 3,814,330 (Masters), and 4,073,302 (Jones), in which a cleaning head or nozzles is attached to a flexible water feed line and inserted into the pipe. The head has jet nozzles which cause water fed from the water hose to be projected backwardly along the pipe so that the head itself is driven along the pipe from a point of access. After a suitable distance has been achieved, the hose is grasped and pulled rearwardly so the head is drawn out of the pipe against the force provided by the water jets. This tends to force the collected material at the bottom of the pipe along the pipe with the returning head so that the material can be withdrawn at the point of access.

The efficiency of this process rests wholly upon the ease with which the head can propel itself along the pipe and, more importantly, the effectiveness of the head in its return path in lifting and transporting the collected debris from the base of the pipe.

SUMMARY OF THE INVENTION

It is one object of the present invention, therefore, to provide a head of this general type which acts more efficiently to lift and transport the collected debris.

According to a first aspect of the invention, therefore, there is provided a head for cleaning the interior of a pipe comprising a circular cylindrical body having a cylindrical peripheral wall and a rear end wall defining a hollow interior, a pipe, one end of said pipe being connected to the end wall such that the pipe extends coaxially and rearwardly therefrom and an opposed end of the pipe having a coupling for receiving a water supply hose whereby water under pressure can be supplied to the hollow interior, means defining a substantially pointed nose supported forwardly and centrally of the cylindrical body, a plurality of skid bars each extending longitudinally along the peripheral wall in spaced relation around the cylindrical body and having a portion thereof inclined inwardly and rearwardly therefrom and a portion inclined inwardly and forwardly therefrom to a position at which it is attached to the nose, and a plurality of jet nozzles mounted on the end face and communicating with the hollow interior whereby said water under pressure can issue therefrom in a rearward direction, the jet nozzles being arranged inwardly of the bars and angularly off-set from the bars so as to direct water rearwardly from the end wall between said inwardly and rearwardly inclined portions of the bars.

According to a second aspect of the invention, therefore, there is provided a head for cleaning the interior of a pipe comprising a circular cylindrical body having a cylindrical peripheral wall and a rear end wall defining a hollow interior, a pipe, one end of said pipe being connected to the end wall such that the pipe extends coaxially and rearwardly therefrom and the other end of the pipe having a coupling for receiving a water supply hose whereby water under pressure can be supplied to the hollow interior, means defining a substantially pointed nose supported forwardly and centrally of the cylindrical body, a plurality of skid bars arranged in spaced relation around the cylindrical body and extending longitudinally of the peripheral wall, and a plurality of jet nozzles mounted on the end wall and communicating with the hollow interior, each jet nozzle defining a directional opening arranged rearwardly and outwardly relative to the axis of the cylindrical body at an angle less than 10° whereby said water under pressure can issue from the jet nozzles in a rearward and slightly outward direction.

According to a third aspect of the invention there is provided a method for cleaning the interior of a pipe comprising attaching to the end of a flexible water supply hose a head comprising a circular cylindrical body having a cylindrical peripheral wall and a rear end wall defining a hollow interior, a pipe, one end of said pipe being connected to the end wall such that the pipe extends coaxially and rearwardly therefrom and an opposed end of the pipe having a coupling for receiving a water supply hose whereby water under pressure can be supplied to the hollow interior, means defining a substantially pointed nose supported forwardly and centrally of the cylindrical body, a plurality of skid bars each extending longitudinally along the peripheral wall in spaced relation around the cylindrical body and a plurality of jet nozzles mounted on the end face and communicating with the hollow interior whereby said water under pressure can issue therefrom in a rearward direction, the diameter of the cylindrical body being less than half of the diameter of the pipe, forcing water under pressure through the hose whereby water issues from said jet nozzles to project the head along the pipe while drawing the hose behind it, and withdrawing the hose from the pipe so as to pull the head rearwardly along the pipe, the weight of the head being sufficient such that the head rests upon the bottom of the pipe with the skid bars running in contact with the bottom of the pipe so that the water issuing from the jet nozzles propels matter resting on the bottom of the pipe along the pipe.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 2:
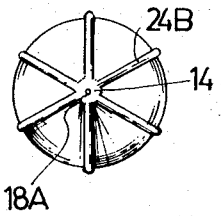
FIG. 2 is a rear elevational view of the head of FIG. 1.
Figure 4:
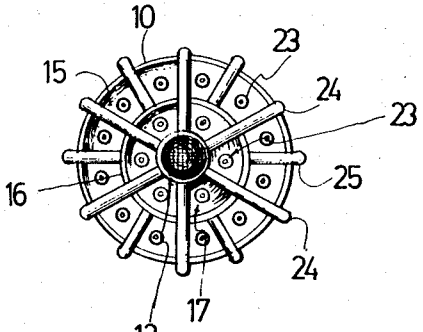
FIG. 4 is a rear elevational view of the head of FIG. 3.

Referring firstly to FIG. 4, the head comprises a cylindrical body formed by a cylindrical peripheral wall 10, a rear wall 11 and a front wall 12. The body thus defines a hollow interior into which water can be supplied by a pipe 13 welded to the rear wall 11 centrally thereof that is coaxially with the cylindrical body.

The front wall 12 of the cylindrical body is conical so as to converge from the peripheral wall 10 to a nose 14 at the apex of the cone with the nose being slightly rounded.

The rear wall 11 comprises a first annular portion 15, an outer edge of which is welded to and sealed with an inner surface of the peripheral wall 11. An inner edge of the annular wall 15 is welded to a cylindrical portion 16 which extends rearwardly out of the annular portion to a further circular portion of the rear wall indicated at 17. Thus both the annular portion 15 and the circular portion 17 lie in radial planes with the portion 17 rearward of the portion 15.

The pipe 13 is welded to the circular portion 17 at an opening therein so that the water in the pipe can be communicated to the interior of the cylindrical body to apply pressure to the rear wall 11. An outer end of the pipe 13 carries a coupling 18 in the form of a screw thread for attachment to a flexible hose as indicated at 19 in FIG. 1. Prior to attachment of the hose 19 to the coupling 18, a filter 20 in the form of a cylindrical mesh is inserted into the pipe, the mesh being closed by an end cap 21. A flange 22 enables the filter to be clamped between the coupling 18 and the hose 19 so that it is held in place while water entering from the hose 19 is forced through the filter to trap any particles which could block the jets described hereinafter. The diameter of the tubular mesh is less than that of the inside surface of the pipe so that water can escape throughout the length of the filter and then run along inside the pipe toward the cylindrical body.

A plurality of jets 23 are attached to the rear wall 11 by welding or other suitable technique. The jets are positioned in a first ring just inside the peripheral wall 10 and in a second ring just inside the tubular portion 16. EAch of the jets is turned so that it is generally directed rearwardly from the rear surface 11 but is angled slightly outwardly relative to the axis of the cylindrical body at an angle less than 10° and preferably in the range 1° to 6°. The orifices of the jets are arranged to be of such a size that together they can create a water flow of approximately 65 gallons per minute which has been found to be suitable for the purposes described herein.

Figure 3:
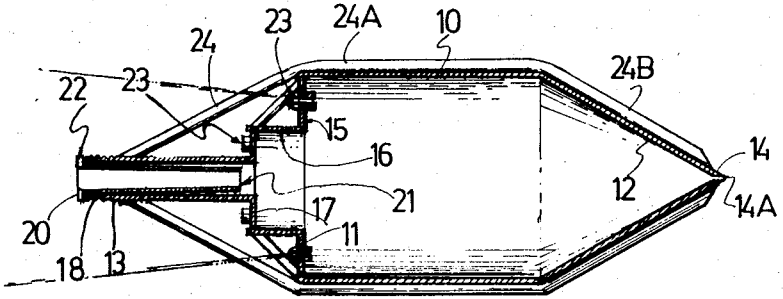
FIG. 3 is a cross-sectional view of a further embodiment of head according to the invention.

A plurality of skid bars, in the embodiment shown in FIGS. 3 and 4, twelve such skid bars, is arranged in equi-angularly spaced arrangement around the cylindrical body. Six of the skid bars indicated at 24 have a rear end welded to the pipe adjacent the coupling 18. From that end the bar inclines outwardly and forwardly to a portion 24A which lies longitudinally of the peripheral surface 10. A forward portion 24B is inclined inwardly and forwardly along the conical surface 12 and is welded to the surface adjacent the nose 14. Alternate ones of the skid bars indicated at 25 follow substantially the path of the bars 24 and lie intermediate the bars 24 but instead of being welded at the end to the pipe 13 are welded to the outside surface of the tubular portion 16. The skid bars thus extend effectively from the forward end of the head to the rearward end and provide a surface on which the head can move over the base of the pipe as shown at 26 in FIG. 1.

As shown in FIG. 4, the jet nozzles 23 are arranged directly midway between respective bars 24, 25 so that water ejected from a particular jet nozzle avoids the bars and can be projected rearwardly and slightly outwardly between the bars. The nozzles of the inner row are arranged immediately inside the ends of the bars 25 so as to lie intermediate the nozzles of the outer row. Such an arrangement is particularly convenient and provides a water flow pattern which is fully free of interference with any bars and extends as far as possible over the full area of the rear wall 11.

Figure 1:
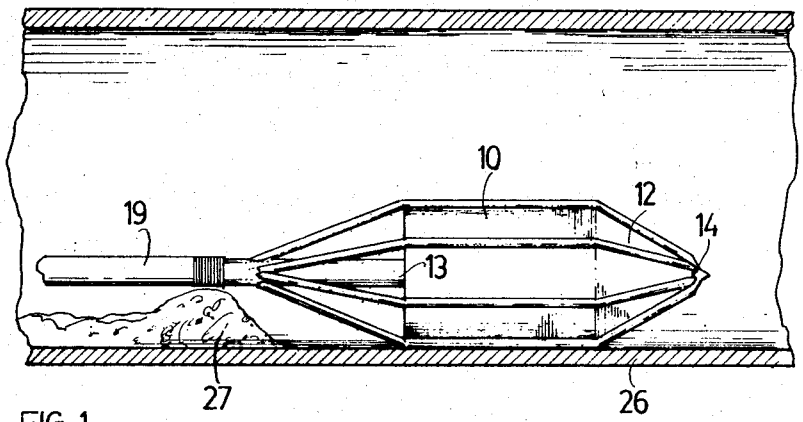
FIG. 1 is a side elevational view of a head according to the invention in operation in a pipe.

The head shown in FIG. 1 differs from that of FIG. 3 in that it is of slightly smaller diameter and the rear wall 11 is a simple planar wall with the nozzles arranged around the wall intermediate the bars so as not to interfere with the bars. In addition the bars all extend to the pipe 13 so as to fully surround the head.

An additional optional nozzle 14A can be positioned at the nose 14 so as to project water forwardly from the body.

In operation the head and hose as shown in FIG. 1 are fed into the pipe 26 and the jets of water from the jets 23 act to drive the head along the pipe drawing the hose behind it. The jet 14A can in some cases act to clear a path ahead of the head. When the head has reached a required distance which in practice is that distance through which the material collected at the base of the pipe can be withdrawn to the point of access, the forward movement of the hose is halted by grasping the hose and the hose is rewound back to the point of access drawing with it the mass 27 of material. The shallow angle of the jets, that is less than 10°, acts to effectively drive the material back from the head as it is drawn toward the point of access. In addition the weight of the head is chosen to be sufficiently heavy so that the head runs on the base of the pipe with the skids sliding across the inner surface of the pipe at the bottom. For this purpose, the diameter of the head is chosen to be less than half of the diameter of the pipe. Thus for example a head of 5 inches diameter may have a weight of the order of 5 kilograms, a head of the order of 6 inches diameter a weight of the order of 6.5 kilograms, a head of the order of 7 inches a weight of the order of 10 kilograms, and a head of the order of 8.5 inches diameter a weight of the order of 20 kilograms. The positioning of the skids in closely spaced relationship around the body allows the heavy skid to move across the surface of the base without being halted by any obstructions and regardless of the orientation of the head so that it can roll or rotate if necessary to maintain the proper position at the base of the pipe.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A head for cleaning the interior of a pipe comprising a circular cylindrical body having a cylindrical peripheral wall and a rear end wall defining a hollow interior, a pipe, one end of said pipe being connected to the end wall such that the pipe extends coaxially and rearwardly therefrom and an opposed end of the pipe having a coupling for receiving a water supply hose whereby water under pressure can be supplied to the hollow interior, means defining a substantially pointed nose supported forwardly and centrally of the cylindrical body, a plurality of skid bars each extending longitudinally along the peripheral wall in spaced relation around the cylindrical body and having a portion thereof inclined inwardly and rearwardly therefrom and a portion inclined inwardly and forwardly therefrom to a position at which it is attached to the nose, and a plurality of jet nozzles mounted on the end face and communicating with the hollow interior whereby said water under pressure can issue therefrom in a rearward direction, the jet nozzles being arranged inwardly of the bars and angularly off-set from the bars so as to direct water rearwardly from the end wall between said inwardly and rearwardly inclined portions of the bars.

2. The invention according to claim 1 wherein the jet nozzles define an opening which is inclined outwardly relative to the axis of the cylindrical body at an angle less than 10°.

3. The invention according to claim 2 wherein the angle lies in the range 1° to 6°.

4. The invention according to claim 1 wherein the cylindrical body includes a conical front wall converging from said cylindrical peripheral wall to an apex defining said nose.

5. The invention according to claim 1 wherein the number of bars is arranged such that the bars are equally spaced around the peripheral wall with spacing between each bar and a next adjacent bar less than 2.5 inches.

6. The invention according to claim 1 wherein the number of bars is arranged such that with the bars spaced equally around the peripheral wall, the angle between each bar and a next adjacent bar is less than 45°.

7. The invention according to claim 1 wherein the rear wall includes an annular outer portion and a circular inner portion lying in a radial plane spaced rearwardly of the annular outer portion, the annular outer portion and the circular inner portion being interconnected by a cylindrical extension wall, both said annular outer portion and said circular inner portion including a plurality of jet nozzles.

8. The invention according to claim 7 wherein the rearwardly and inwardly inclined portion of some of said bars is connected to said extension wall and the rearwardly and inwardly inclined portion of others of said bars is connected to said pipe.

9. The invention according to claim 1 including a cylindrical filter screen having a circular flange at one end for insertion into the pipe such that the flange can be clamped between the coupling and the supply hose.

10. A head for cleaning the interior of a pipe comprising a circular cylindrical body having a peripheral wall which is a circular cylinder of constant outer diameter and a rear end wall generally at right angles to a longitudinal axis of the body so as to define therewith a hollow interior, a pipe, one end of said pipe being connected to the end wall such that the pipe extends coaxially and rearwardly therefrom and the other end of the pipe having a coupling for receiving a water supply hose whereby water under pressure can be supplied to the hollow interior, means defining a substantially pointed nose supported forwardly and centrally of the cylindrical body, a plurality of skid bars arranged in spaced relation around the cylindrical body each comprising an elongate straight rod portion attached to the peripheral wall such that the rod portion extends longitudinally along the peripheral wall parallel to the axis, and a plurality of jet nozzles mounted on the end wall in spaced relation around the pipe adjacent the peripheral wall and communicating with the hollow interior, each jet nozzle defining a directional opening arranged rearwardly and outwardly relative to the axis of the cylindrical body at an angle less than 10° whereby said water under pressure can issue from the jet nozzles in a rearward and slightly outward direction.

11. The invention according to claim 10 wherein the angle lies in the range 1° to 6°.

12. The invention according to claim 10 wherein the cylindrical body includes a conical front wall converging from said cylindrical peripheral wall to an apex defining said nose.

13. The invention according to claim 10 wherein the number of bars is arranged such that the bars are equally spaced around the peripheral wall with spacing between each bar and a next adjacent bar less than 2.5 inches.

14. The invention according to claim 10 wherein the number of bars is arranged such that with the bars spaced equally around the peripheral wall, the angle between each bar and a next adjacent bar is less than 45°.

15. The invention according to claim 10 wherein the rear wall includes an annular outer portion and a circular inner portion lying in a radial plane spaced rearwardly of the annular outer portion, the annular outer portion and the circular inner portion being interconnected by a cylindrical extension wall, both said annular outer portion and said circular inner portion including a plurality of jet nozzles.

16. The invention according to claim 15 wherein the rearwardly and inwardly inclined portion of some of said bars is connected to said extension wall and the rearwardly and inwardly inclined portion of others of said bars is connected to said pipe.

17. The invention according to claim 10 including a cylindrical filter screen having a circular flange at one end for insertion into the pipe such that the flange can be clamped between the coupling and the supply hose.

18. A head for cleaning the interior of a pipe comprising a circular cylindrical body having a peripheral wall which is a circular cylinder of constant outer diameter and a rear end wall generally at right angles to a longitudinal axis of the body so as to define therewith a hollow interior, a pipe, one end of said pipe being connected to the end wall such that the pipe extends coaxially and rearwardly therefrom and the other end of the pipe having a coupling for receiving a water supply hose whereby water under pressure can be supplied to the hollow interior, means defining a substantially pointed nose supported forwardly and centrally of the cylindrical body, a plurality of skid bars arranged in spaced relation around the cylindrical body each comprising an elongate straight rod portion attached to the peripheral wall such that the rod portion extends longitudinally along the peripheral wall parallel to the axis, and a plurality of jet nozzles mounted on the end wall in spaced relation around the pipe adjacent the peripheral wall and communicating with the hollow interior, each jet nozzle defining a directional opening arranged rearwardly and outwardly relative to the axis of the cylindrical body at an angle less than 10° whereby said water under pressure can issue from the jet nozzles in a rearward and slightly outward direction, said jet nozzles being arranged such that substantially the whole of said water under pressure supplied to the hollow interior exits through said jet nozzles in said end wall in said rearward and slightly outward direction.

* * * * *